US006945322B2

(12) United States Patent
Ikeda

(10) Patent No.: US 6,945,322 B2
(45) Date of Patent: Sep. 20, 2005

(54) HEAT EXCHANGER

(75) Inventor: Toru Ikeda, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/744,647

(22) Filed: Dec. 22, 2003

(65) Prior Publication Data

US 2004/0194933 A1 Oct. 7, 2004

(30) Foreign Application Priority Data

Dec. 26, 2002 (JP) ..... 2002-376959

(51) Int. Cl.[7] ..... F28F 9/26
(52) U.S. Cl. ..... 165/144; 165/153
(58) Field of Search ..... 165/143–153

(56) References Cited

U.S. PATENT DOCUMENTS 4,295,521 A * 10/1981 Sommars ..... 165/69
4,332,291 A * 6/1982 Mulock-Bentley ..... 165/76
4,741,392 A * 5/1988 Morse ..... 165/76
5,499,674 A * 3/1996 Bartz et al. ..... 165/76
5,584,340 A * 12/1996 Derosier ..... 165/82
5,927,390 A * 7/1999 Lehman ..... 165/122
6,044,900 A * 4/2000 Kawahara ..... 165/110
6,250,379 B1 * 6/2001 Geissler et al. ..... 165/158
6,668,914 B2 * 12/2003 Langl ..... 165/145

FOREIGN PATENT DOCUMENTS

JP 2001-91187 4/2001

* cited by examiner

*Primary Examiner*—Teresa J. Walberg
(74) *Attorney, Agent, or Firm*—Harness, Dickey & Pierce, PLC

(57) ABSTRACT

Metal side plates having projections are attached to fins at the ends of heat exchanger units, to thereby carry out heat exchange between cooling air flowing through spaces between the heat exchanger units, and the side plates. In comparison with a conventional radiator having no side plate, a heat exchanging area (heat radiating area) for the cooling air flowing through the spaces can be increased and, thus, a heat exchangeability (heat radiation capacity) can be enhanced in the present invention.

3 Claims, 6 Drawing Sheets

HEAT EXCHANGER

BACKGROUND OF THE INVENTION

1. Field of the Invention

The present invention relates to a heat exchanger which can be effectively applied to a radiator for a large construction machine, such as a bulldozer, a power shovel, etc., and for an agricultural machine such as a tractor, etc.

2. Description of the Related Art

A large construction machine, such as a bulldozer, a power shovel, etc., or an agricultural machine such as a tractor, etc. (hereinafter, there machines are generally referred to as special vehicles) are often used in an environment where comparatively large materials, such as gravel, are scattered. Thus, it is highly probable that a radiator is damaged by scattered materials, such as gravel, coming into collision therewith.

Accordingly, as shown in FIG. 5, a radiator for a special vehicle is constituted by a single large radiator having a plurality of heat exchanger units 4 arranged in parallel, which are each comprised of tubes, fins and header tanks, etc. Thus, the heat exchanger units 4 can be replaced or repaired independently of one another to thereby increase the maintainability of the radiator.

A special vehicle is subject to much larger vehicle vibration than an ordinary vehicle such as a passenger automobile, etc. In addition, in a special vehicle, the heat exchanger units must be easily assembled and disassembled. To this end, at present, the adjacent heat exchanger units are spaced at a distance large enough to prevent interference of the adjacent heat exchanger units and to enhance the mounting/demounting efficiency.

However, because the above-mentioned radiator is provided with comparatively large spaces 7 between the adjacent heat exchanger units 4, as shown in FIG. 6, cooling air passes through the spaces 7, so that the amount of cooling air that contributes to a heat exchange is reduced, thus resulting in deterioration of the heat exchanging efficiency (cooling efficiency).

SUMMARY OF THE INVENTION

In view of the above-mentioned drawbacks, an object of the present invention is primarily to provide a novel heat exchanger distinguished from a conventional heat exchanger. Another object of the present invention is to provide a heat exchanger having a higher heat exchangeability than a conventional heat exchanger.

In order to achieve the above-mentioned object, according to a first embodiment of the present invention, a heat exchanger comprises a plurality of heat exchanger units (4) which comprise a plurality of metal tubes (1) in which a fluid passes, metal fins (2) in contact with outer surfaces of the tubes (1) to promote heat exchange between the fluid and air, and header tanks (3) provided at opposite ends of the tubes (1) in the longitudinal direction and connecting to the plural tubes (1), and base header tanks (6) connecting to the respective header tanks (3) of the plural heat exchanger units (4), wherein the heat exchange units (4) are provided, on their ends in a direction orthogonal to the longitudinal direction of the tubes (1), with metal side plates (5) which are elongated in a direction parallel to the longitudinal direction of the tubes (1) which are connected to the fins (2).

With this structure, heat exchange can be carried out between the air, passing through the spaces between the adjacent heat exchanger units (4), and the side plates (5).

Compared to a conventional radiator having no side plate (5), a heat exchanging area for the air passing through the spaces between the heat exchange units (4) can be increased, to thereby enhance the heat exchangeability, in the present invention.

In a second embodiment of the present invention, the fins (2) are corrugated and attached to the outer surfaces of the tubes (1).

In a third embodiment of the present invention, the side plates (5) are provided, on the outer surfaces thereof, with projections **(5*a*) projecting toward the adjacent side plates (5)**.

Thus, the heat exchanging area is increased compared to an absence of the projections **(5*a*)** and, thereby, the heat exchangeability can be further enhanced.

In a fourth embodiment of the present invention, the projections **(5*a*) provided on one of the two adjacent side plates (5) are deviated from the projections (5*a*) provided on the other side plate, in the longitudinal direction of the side plates (5)**.

With this arrangement, no interference (collision) due to an oscillation of the heat exchanger units (4), caused by vehicle oscillation, etc., occurs between the projections **(5*a*)**.

The numerical references attached in parentheses to the component names described above are given to show an example of correspondence to specific components of embodiments to be described later.

The present invention may be more fully understood from the description of preferred embodiments of the invention set forth below, together with the accompanying drawings.

DESCRIPTION OF PREFERRED EMBODIMENTS

Figure 1:
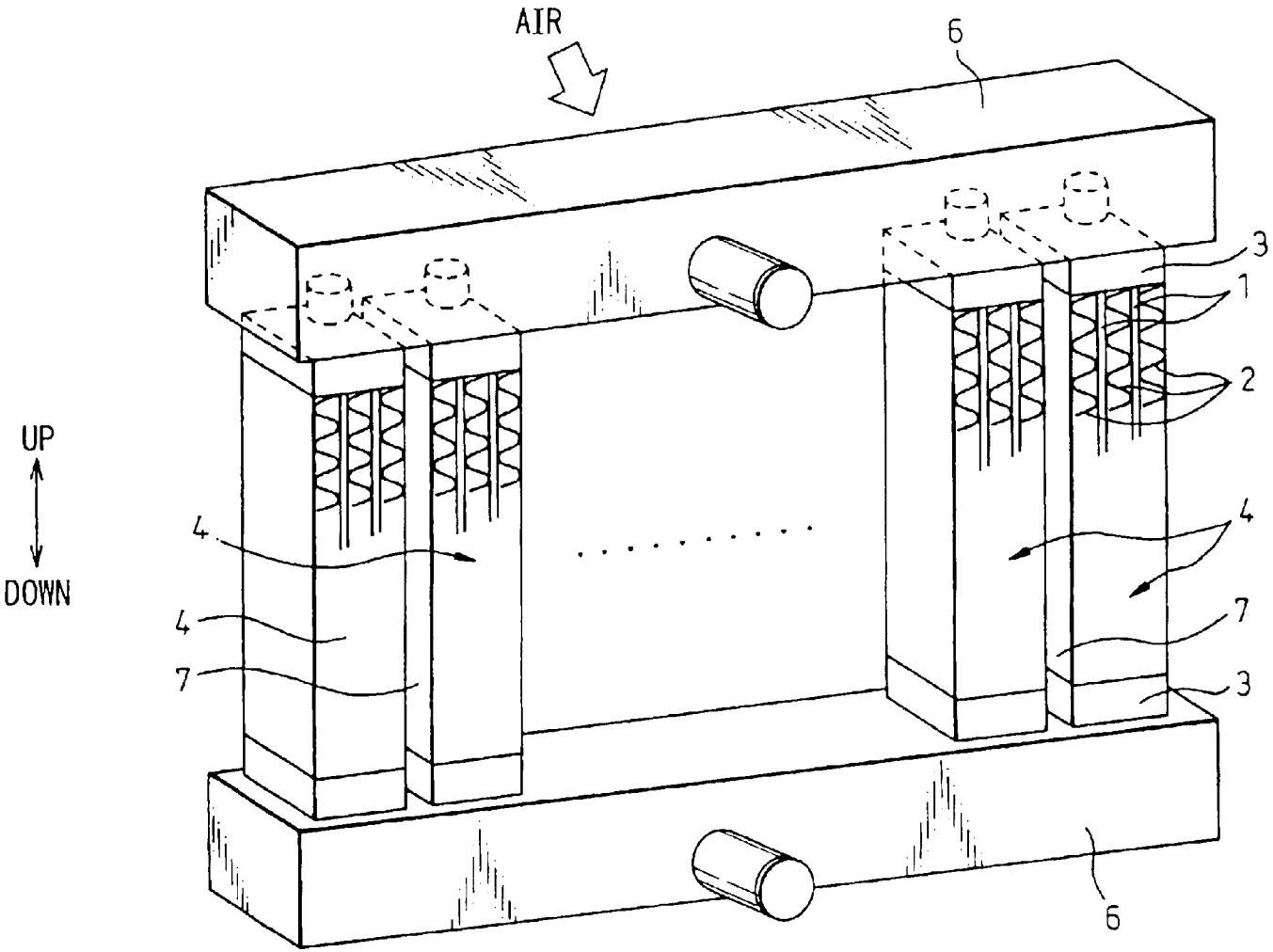
FIG. 1 shows a perspective view of a radiator according to an embodiment of the present invention.
Figure 2:
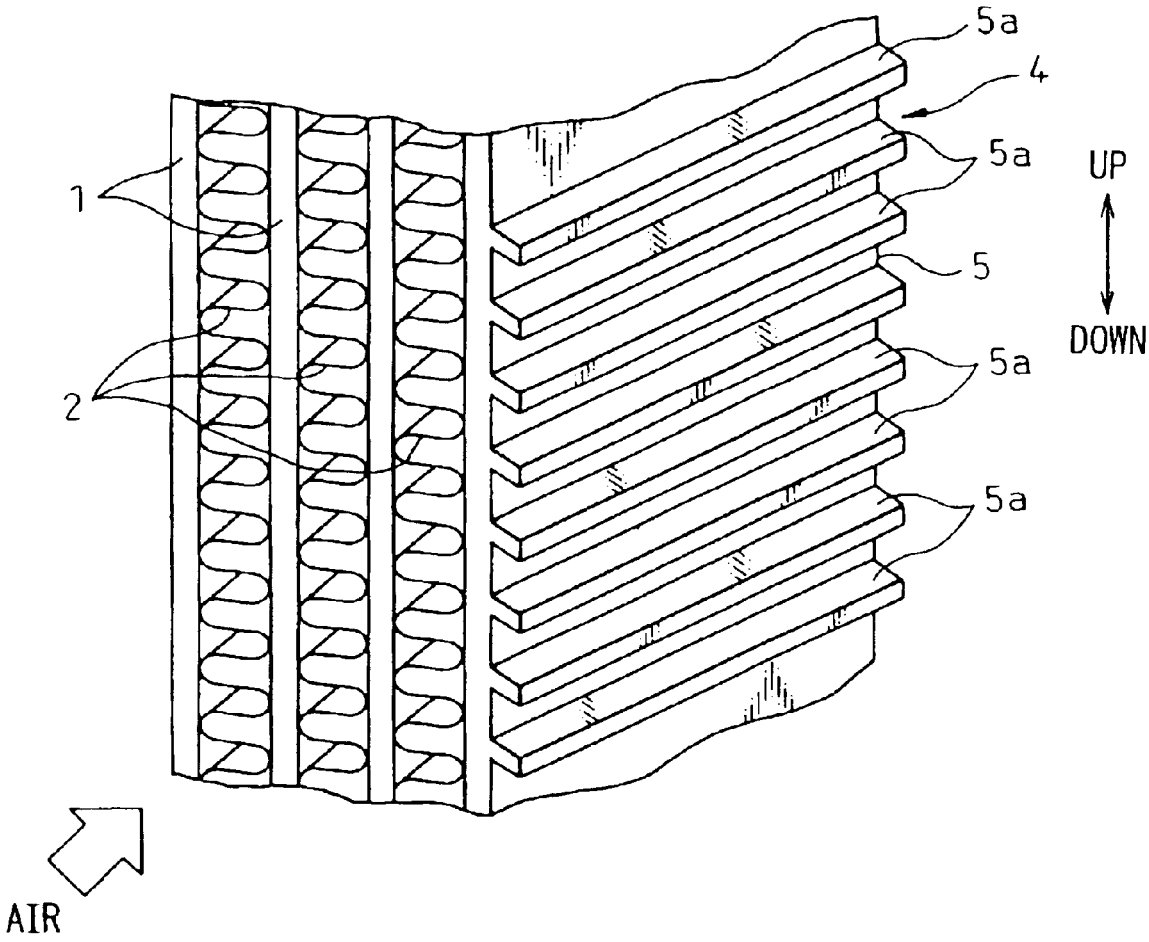
FIG. 2 shows a perspective view of a heat exchanger unit according to a first embodiment of the present invention.

A first embodiment of the present invention will be explained. In this embodiment, the present invention is applied to a radiator for a special vehicle. FIG. 1 shows an external appearance of a radiator according to the first embodiment. FIG. 2 is an enlarged view of a heat exchanger unit 4.

The radiator is provided in the special vehicle so as to receive cooling air supplied by a blower provided on the upstream side of an air stream. The blower is driven by power generated by an engine E/G.

As shown in FIG. 1, a heat exchanger core portion of the radiator according to the present embodiment is constituted by a plurality of heat exchanger units 4 which are juxtaposed in a direction transverse to the flowing direction of the cooling air, and which comprise a plurality of aluminum tubes 1 through which the cooling water passes, corrugated aluminum fins 2 brazed or welded to the outer surfaces of the tubes 1 for promoting heat exchange between the cooling water and the cooling air, and aluminum header tanks 3 provided at both ends, in the longitudinal direction, of the tubes 1 and communicating with the plural tubes 1, etc.

In this embodiment, each heat exchanger unit 4 is comprised of about 50 to 100 flat tubes 1, and fins 2 attached to the flat surfaces thereof, so that the heat exchanger unit has a heat radiating capacity of about 100 to 200W. The number of the units 4 can be varied depending on the specification (required heat radiation capacity) of the radiator, so as to meet various specifications.

As shown in FIG. 2, the heat exchanger units 4 are provided, in their ends in a direction orthogonal to the longitudinal direction of the tubes 1, with aluminum side plates 5 which are brazed or welded at least to the fins 2, and which are elongated in a strip-form, in a direction parallel to the longitudinal direction of the tubes 1. The side plates 5 are provided, at least on the opposed outer surfaces of the adjacent side plates 5, with projections 5*a* projecting toward the opposed side plates 5.

Figure 3:
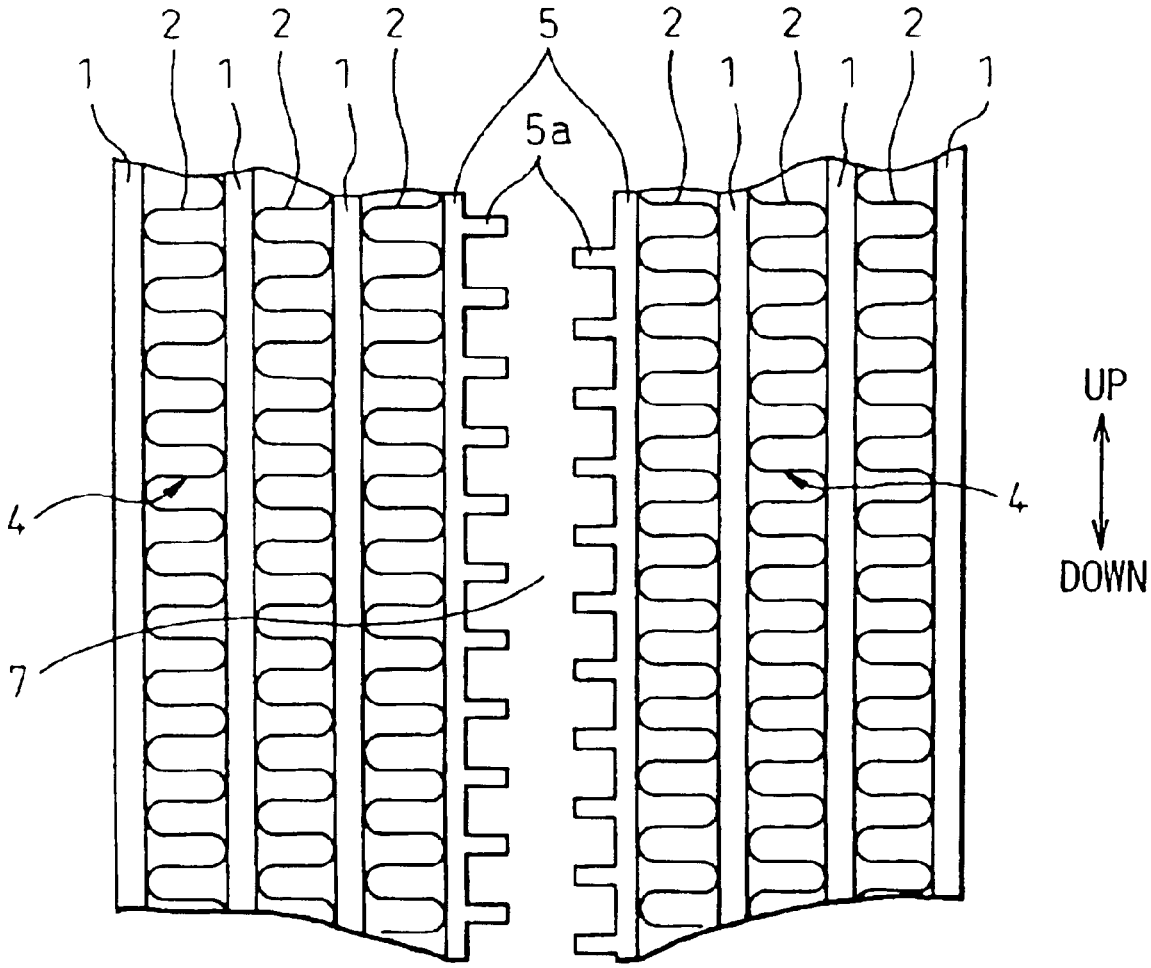
FIG. 3 shows a front view of a heat exchanger unit according to a first embodiment of the present invention.

As shown in FIG. 3, the projections 5*a* provided on one of the two adjacent side plates 5 and the projection 5*a* provided on the other side plate are staggered in the longitudinal direction of the side plates 5.

In the present embodiment, the projections 5*a* are formed in a strip extending in the flowing direction of the air. The projections 5*a* are integrally formed with the side plate 5 by cutting a blank, produced through an extrusion process or a drawing process, in the flowing direction of the air and at a predetermined width.

As shown in FIG. 1, the heat exchanger units 4 are provided, at opposite ends thereof in the longitudinal direction, with base header tanks 6 communicating with the respective header tanks 3 of the heat exchanger unit 4. The cooling water is distributed and supplied from the upper base header tank 6, in the drawing, to each heat exchanger unit 4. The cooling water flowing from each heat exchanger unit 4 is gathered and recovered in the lower base header tank 6 in the drawing.

Because the heat exchanger units 4 are inserted in and attached to the base header tanks 6 through sealing members, that is, rubber grommets which also serve as packings, and the length of the heat exchanger units in the longitudinal direction is 1 m or more, which is longer than that of a radiator for an ordinary vehicle, the heat exchanger units may be deflected due to the vehicle vibration, thus leading to occurrence of interference between the adjacent heat exchanger units 4, as mentioned above.

The mode of operation and the effects of the present embodiment will be explained below.

In the present embodiment, the metal side plates 5 connected to the fins 2 are provided at the ends of the heat exchanger units 4 and, hence, heat exchange can be carried out between the cooling air, flowing through the spaces 7 (see FIGS. 1 and 3) between the adjacent heat exchanger units 4, and the side plates 5.

In comparison with a conventional radiator without the side plates 5, the heat exchanging area (heat radiating area) for the cooling air flowing through the spaces is increased, and, thus, the heat exchangeability (heat radiation capability) can be enhanced in the present invention.

Also, as the projections 5*a* are provided on the side plates 5, the heat exchanging area (heat radiating area) can be increased compared with those having no projections 5*a*. Consequently, the heat exchangeability (heat radiation capability) can be further increased.

Also, as the projections 5*a* provided on one of the two adjacent side plates 5 and the projections 5*a* provided on the other side plate are deviated, in the longitudinal direction of the side plates 5, even if the heat exchanger units 4 vibrate due to the vehicle vibration, no interference (collision) with the projections 5*a* takes place.

Figure 4:
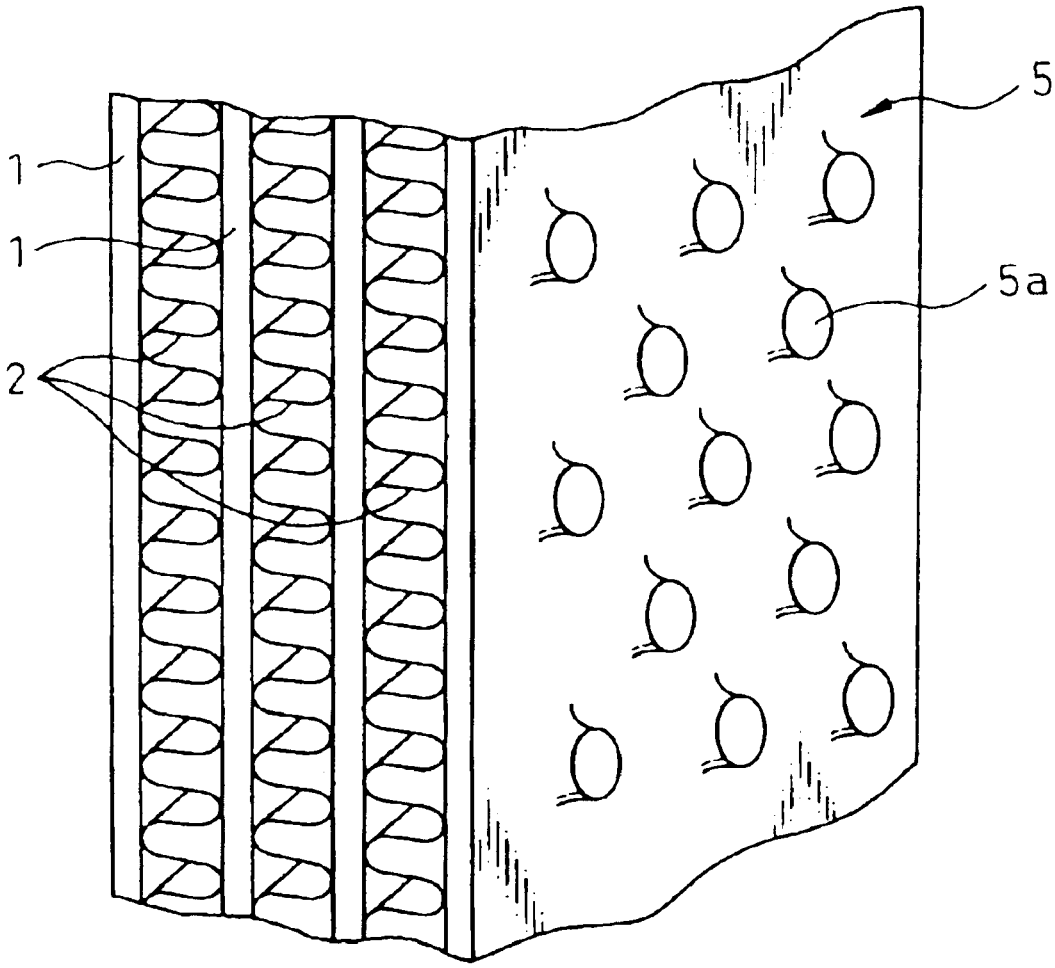
FIG. 4 shows a perspective view of a heat exchanger unit according to a second embodiment of the present invention.
Figure 5:
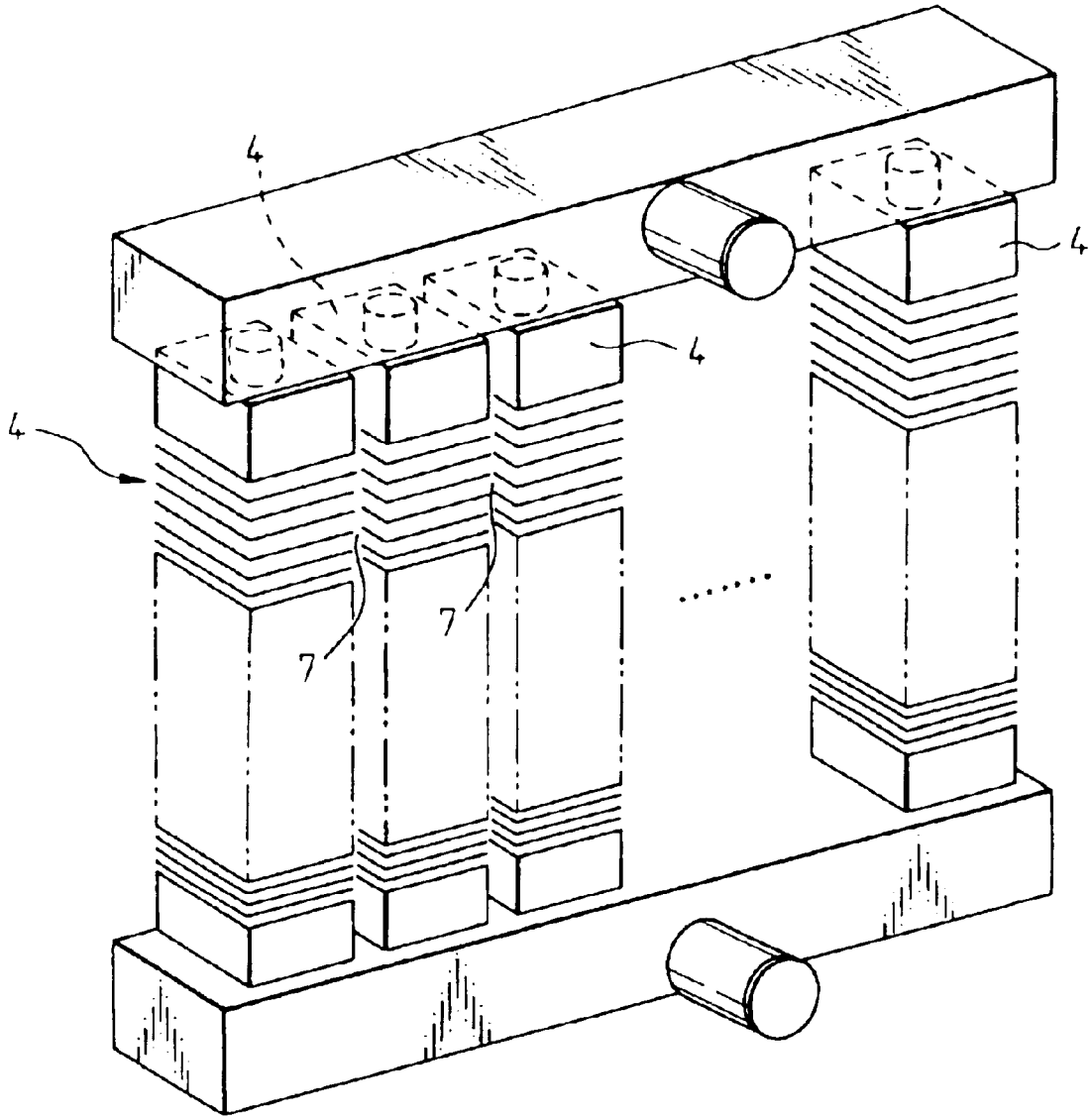
FIG. 5 shows a perspective view of a radiator according to the prior art.
Figure 6:
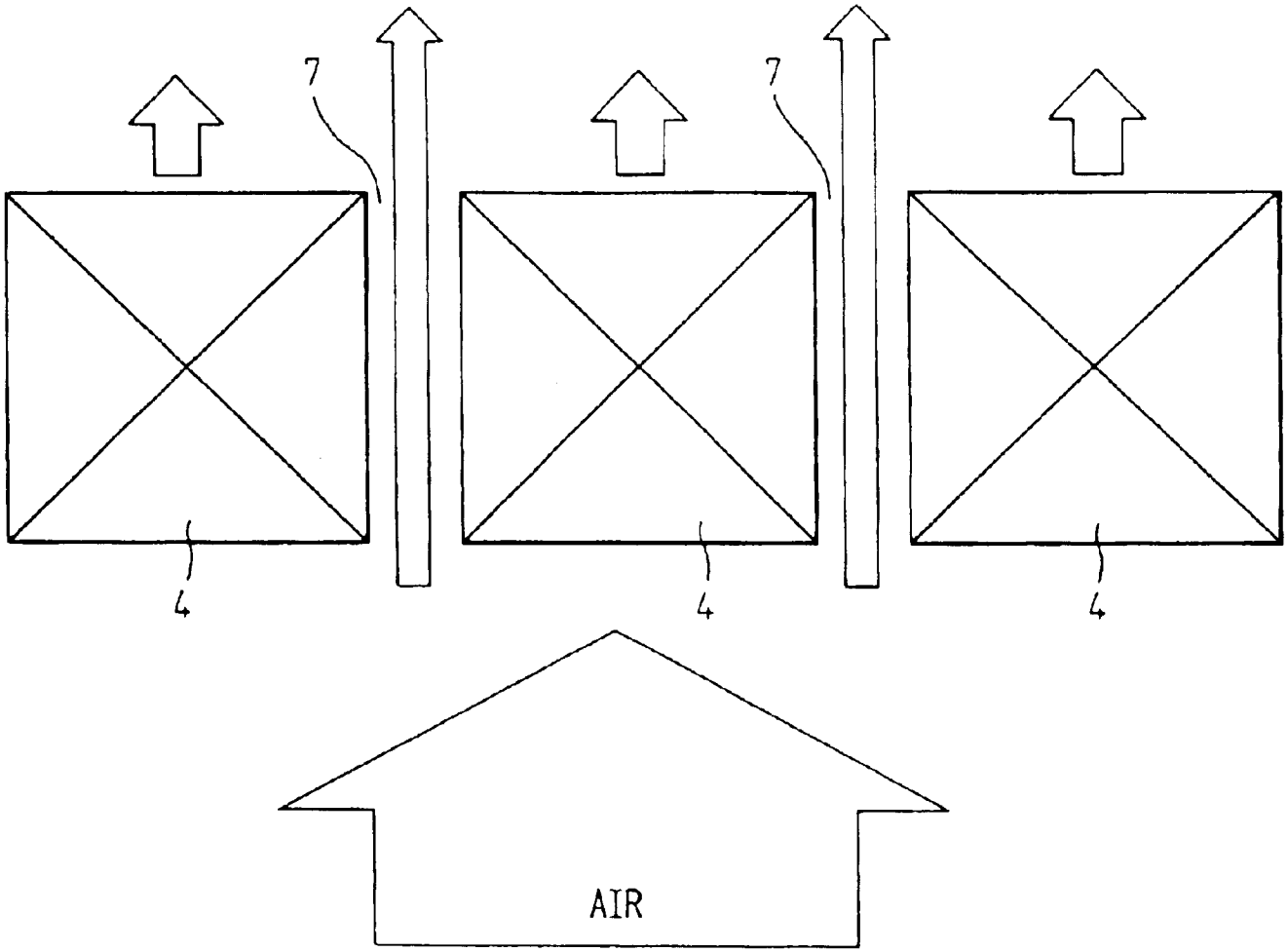
FIG. 6 shows an explanatory view for explaining drawbacks of a radiator according to the prior art.

Next, a second embodiment will be explained. Although the projections 5*a* are elongated in a strip shape, in the first embodiment, a large number of projections 5*a* in the form of domes or dimples are formed on the side plates 5 by a plastic working, such as embossing or press-machining of a blank plate, in the present embodiment, as shown in FIG. 4.

In the present embodiment, the projections 5*a* provided on one of the two adjacent side plates 5 and the projections 5*a* provided on the other side plate are deviated from one another, in the longitudinal direction of the side plates 5, so that the projections are staggered in the flowing direction of the air.

Other embodiments will be explained. In the above-mentioned embodiments, corrugated fins are used as the fins 2. However, the present invention is not limited thereto. For example, plate-fins can be used, wherein the tubes 1 which are inserted in holes formed in elongated thin plates extending in a direction orthogonal to the longitudinal direction of the tubes 1 are deformed to increase the diameter of the tubes 1 to thereby mechanically secure the tubes 1 to the thin plate.

Also, the shape of the projections 5*a* provided on the side plates 5 is not limited to those described in the above-mentioned embodiments. For example, offset-type fins may be used. The offset-type fins refer to those comprised of a plurality of planar segments arranged in a zigzag order.

Although the heat exchanger according to the present invention has been applied to a radiator for a special vehicle in the above-mentioned embodiments, the application of the present invention is not limited thereto.

While the invention has been described by reference to specific embodiments chosen for purposes of illustration, it should be apparent that numerous modifications could be made thereto by those skilled in the art without departing from the basic concept and scope of the invention.

What is claimed is:

1. A heat exchanger comprising a plurality of heat exchanger units (4) which comprises a plurality of metal tubes (1) in which a fluid passes, metal fins (2) in contact with outer surfaces of said tubes (1) to promote heat exchange between said fluid and air, and header tanks (3) provided at opposite ends of said tubes (1) in the longitudinal direction and connecting to the plural tubes (1), and base header tanks (6) connecting to the respective header tanks (3) of the plural heat exchanger units (4), wherein the heat exchange units (4) are provided, on their ends in a direction orthogonal to the longitudinal direction of said tubes (1), with metal side plates (5) which are elongated in a direction parallel to the longitudinal direction of said tubes (1) which are connected to said fins (2) and the side plates (5) are provided, on the outer surfaces thereof, with projections (5*a*) projecting toward adjacent side plates (5).

2. A heat exchanger according to claim 1, wherein the fins (2) are formed in a corrugated shape and connected to the outer surfaces of said tubes (1).

3. A heat exchanger according to claim 1, wherein the projections (5*a*) provided on one of the two adjacent side plates (5) and the projections (5*a*) provided on the other side plate are deviated from each other, in the longitudinal direction of the said plates (5).

* * * * *